US008113155B2

(12) United States Patent
Ooniwa et al.

(10) Patent No.: US 8,113,155 B2
(45) Date of Patent: Feb. 14, 2012

(54) TWO-CYCLE ENGINE

(75) Inventors: Takashi Ooniwa, Kawagoe (JP); Hideo Koizumi, Kawagoe (JP)

(73) Assignee: Husqvarna Zenoah Co., Ltd., Kawagoe-shi (JP)

( * ) Notice: Subject to any disclaimer, the term of this patent is extended or adjusted under 35 U.S.C. 154(b) by 722 days.

(21) Appl. No.: 12/224,771

(22) PCT Filed: Mar. 6, 2007

(86) PCT No.: PCT/JP2007/054285

§ 371 (c)(1),
(2), (4) Date: Sep. 5, 2008

(87) PCT Pub. No.: WO2007/102486

PCT Pub. Date: Sep. 13, 2007

(65) Prior Publication Data

US 2009/0050124 A1 Feb. 26, 2009

(30) Foreign Application Priority Data

Mar. 7, 2006 (JP) ..... 2006-061312

(51) Int. Cl.
*F02F 1/22* (2006.01)
*F02B 25/00* (2006.01)

(52) U.S. Cl. ..... 123/65 P; 123/65 R; 123/65 V

(58) Field of Classification Search ..... 123/65 P
See application file for complete search history.

(56) References Cited

U.S. PATENT DOCUMENTS 4,498,434 A 2/1985 Baltz et al.
4,727,828 A * 3/1988 Ueno et al. ..... 123/2
5,699,761 A * 12/1997 Yamaguchi et al. ..... 123/73 A
6,173,683 B1 * 1/2001 Nemoto et al. ..... 123/73 PP
6,263,841 B1 * 7/2001 Beveridge ..... 123/73 R
6,367,431 B1 * 4/2002 Nemoto et al. ..... 123/65 P
6,505,616 B2 * 1/2003 Hehnke ..... 123/588
6,598,568 B2 * 7/2003 Rosskamp et al. ..... 123/73 PP
6,606,971 B2 * 8/2003 Abei ..... 123/73 C
6,679,211 B2 * 1/2004 Nickel ..... 123/179.14
6,782,851 B2 * 8/2004 Geyer ..... 123/73 B
2003/0010297 A1 1/2003 Strom et al.

FOREIGN PATENT DOCUMENTS

JP 60-13969 1/1985
JP 63-239346 10/1988
JP 02-211364 A 8/1990
JP 03-249361 A 11/1991
JP 06-159146 A 6/1994
JP 2002-339805 A 11/2002
JP 2003-519753 A 6/2003

OTHER PUBLICATIONS

Notification Concerning Transmittal of International Preliminary Report on Patentability, Chapter I of the Patent Cooperation Treaty and PCT Written Opinion of the International Searching Authority for PCT/JP2007/054285, 6 sheets.

* cited by examiner

*Primary Examiner* — Michael Cuff
*Assistant Examiner* — Grant Moubry
(74) *Attorney, Agent, or Firm* — Holtz, Holtz, Goodman & Chick, PC

(57) ABSTRACT

A two-cycle engine includes a starting fuel supply passage for supplying a starting fuel to a crankcase from a starting fuel reservoir, and a flow passage opening and closing unit provided in a midway portion of the starting fuel supply passage. The starting fuel supply passage is opened to be constantly in communication with the crankcase. Accordingly, simultaneously with the generation of a negative pressure within the crankcase when a piston starts to ascend from a bottom dead center, the starting fuel starts to be supplied to the crankcase. Since the starting fuel is supplied to the crankcase for a relatively long time as compared to a conventional engine, a sufficient amount of the fuel is supplied for starting and startability of the two-cycle engine is improved.

4 Claims, 4 Drawing Sheets

TWO-CYCLE ENGINE

This application is a U.S. National Phase Application under 35 USC 371 of International Application PCT/JP2007/054285 filed Mar. 6, 2007.

TECHNICAL FIELD

The present invention relates to a two-cycle engine and more particularly to a two-cycle engine including an automatic choke.

BACKGROUND ART

A small-displacement two-cycle engine is generally used for a portable work machine such as a brushcutter, a chain saw and the like. Such a portable work machine often includes an automatic choke to improve startability of a cold engine. The automatic choke has various structures. For example, the automatic choke may include a solenoid valve integrated with a carburetor.

Such an automatic choke includes a starting fuel supply passage which extends from a fuel reservoir of the carburetor and which is apertured in an intake passage of the carburetor, and the solenoid valve as a flow passage opening and closing unit provided in the middle of the starting fuel supply passage. When the solenoid valve is opened, a fuel to be excessively enriched, i.e. a starting fuel, is supplied to the intake passage from the fuel reservoir through the starting fuel supply passage due to a negative pressure in the intake passage.

In the two-cycle engine having such an automatic choke, the intake passage of the engine in which a piston valve is employed as an intake method is apertured in a cylinder as an intake port, and is opened and closed by a reciprocating piston. In such a conventional two-cycle engine, when the intake port is opened by moving the piston from a bottom dead center to a top dead center, the negative pressure is applied in the intake passage from the crankcase to supply a fuel to the intake passage from the starting fuel supply passage (for example, see Patent Document 1).

[Patent Document] JP-A-2002-339805

DISCLOSURE OF THE INVENTION

Problems to be Solved by the Invention

However, in such a conventional two-cycle engine, the negative pressure is applied only for a short time after the intake port is opened while the piston ascends to the top dead center until the piston reaches to the top dead center. In addition, for example, when a piston ring is not comfortably fitted into a new engine so that its sealing properties is not sufficiently exhibited, the negative pressure applied in the crankcase is reduced, whereby the negative pressure applied in the intake passage is reduced. In other words, the negative pressure is applied in the intake passage only for a short time while the intake port is opened in the conventional two-cycle engine. In addition, the negative pressure is not sufficiently applied in the intake passage, for example, when the sealing properties is not excellent. Thus, a sufficient amount of the starting fuel is not supplied to the intake passage and the startability is impaired.

An object of the present invention is to provide a two-cycle engine having excellent startability.

Means for Solving the Problems

A two-cycle engine according to an aspect of the invention includes: a starting fuel supply passage for supplying a starting fuel to a crankcase from a starting fuel reservoir; and a flow passage opening and closing unit provided in a midway portion of the starting fuel supply passage, in which the starting fuel supply passage is opened to be constantly in communication with the crankcase.

In this arrangement, the starting fuel supply passage is opened to be constantly in communication with the crankcase irrespective of the location of the piston which reciprocates between a bottom dead center and a top dead center. Thus, simultaneously with the generation of a negative pressure within the crankcase when the piston starts to ascend from the bottom dead center, the starting fuel starts to be supplied to the crankcase. Consequently, the starting fuel can be supplied to the crankcase for a relatively long time as compared to a conventional engine. Even when the negative pressure is reduced because of poor sealing properties, a sufficient amount of the fuel can be supplied for starting and startability of the engine can be improved.

Further, since the negative pressure is applied only in the starting fuel supply passage and is not applied in the intake passage until the intake port is opened, the negative pressure applied in the starting fuel supply passage is increased so that the starting fuel can be reliably supplied to the crankcase from the starting fuel supply passage.

Furthermore, the starting fuel can be supplied at a high speed in response to the pressure from the crankcase since the starting fuel supply passage has a small diameter.

The two-cycle engine may include: an intake passage for feeding an air-fuel mixture into the crankcase; a pump for feeding a fuel to be supplied to the intake passage into a fuel reservoir in a carburetor from a fuel tank while being operated by a pressure variation in the crankcase; and a pulsation transfer passage for transferring the pressure variation in the crankcase to the pump, in which the fuel reservoir in the carburetor is the starting fuel reservoir, and the pulsation transfer passage serves as a part of the starting fuel supply passage.

In this arrangement, the pulsation transfer passage serves as the part of the starting fuel supply passage. Thus, it is not necessary to provide a dedicated starting fuel supply passage, whereby a structure of the engine can be simplified and a manufacturing cost thereof can be reduced.

The two-cycle engine may include: an intake passage for feeding an air-fuel mixture into the crankcase; a pump for feeding a fuel to be supplied to the intake passage into a fuel reservoir in a carburetor from a fuel tank while being operated by a pressure variation in the crankcase; and a pulsation transfer passage for transferring the pressure variation in the crankcase to the pump, in which the starting fuel reservoir is the fuel reservoir in the carburetor, and the starting fuel supply passage is provided separately from the pulsation transfer passage.

In this arrangement, since the starting fuel supply passage is provided separately from the pulsation transfer passage, the degree of freedom in design is enhanced. Thus, the most appropriate diameter of the starting fuel supply passage can be decided to provide an excellent response while supplying the starting fuel supply with reliability.

The starting fuel supply passage may include a tube that intercommunicates the carburetor and the crankcase.

In this arrangement, it is not necessary that a starting fuel supply passage having a complicated shape is provided in the carburetor, and is only necessary that the tube is provided in the carburetor. Thus, a structure of the engine can be simplified and a manufacturing thereof can be facilitated.

BEST MODE FOR CARRYING OUT THE INVENTION

First Exemplary Embodiment

A first exemplary embodiment of the invention will be described below with reference to the drawings.

Figure 1:
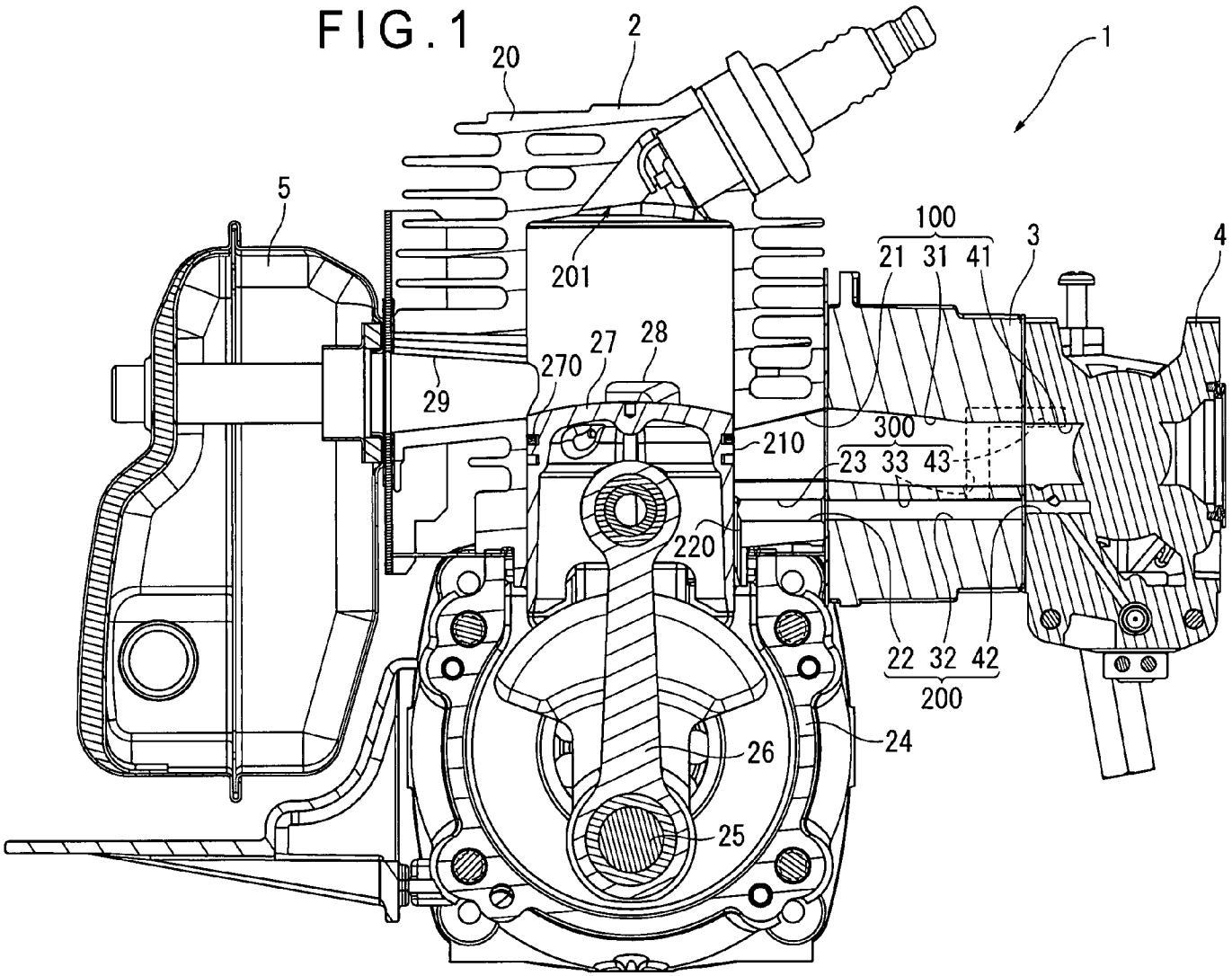
FIG. 1 is a cross sectional view illustrating a two-cycle engine according to a first exemplary embodiment of the invention.

FIG. 1 is a cross sectional view illustrating a two-cycle engine 1 according to the first exemplary embodiment of the invention.

As shown in FIG. 1, the two-cycle engine 1 includes an engine body 2, a carburetor 4 attached to the engine body 2 through an insulator 3, and a muffler 5 attached to interpose the engine body 2 between the muffler 5 and the insulator 3.

The engine body 2 includes a cylinder 20, a crankcase 24 provided on a lower side of the cylinder 20, a crankshaft 25 supported by the crankcase 24, and a piston 27 connected to the crankshaft 25 through a connecting rod 26 and slidably inserted into the cylinder 20 with a piston ring 270. The cylinder 20 includes a combustion chamber 201 above the piston 27 therein.

The cylinder 20 includes a cylinder intake passage 21 which is apertured on an inner circumference of the cylinder 20 as an intake port 210 for feeding air-fuel mixture into the crankcase 24 in an intake process. A piston valve method is employed as an intake method of the air-fuel mixture, in which the intake port 210 is opened and closed on an outer circumference of the piston 27. The cylinder 20 further includes a scavenging passage 28 for scavenging exhaust gas into the combustion chamber 201 in a scavenging process and an exhaust passage 29 for feeding the scavenged exhaust gas into the muffler 5. A cylinder starting fuel supply passage 22 which is apertured in a groove-shaped portion 220 formed on the inner circumference of the cylinder 20 is provided below the cylinder intake passage 21.

The cylinder starting fuel supply passage 22 communicates with the crankcase 24 through the groove-shaped portion 220 when the piston 27 is located on a side close to a bottom dead center (as shown in FIG. 1), and is apertured in a lower space of the piston 27 within the cylinder 20 to communicate with the crankcase 24 when the piston 27 is located on the other side close to a top dead center. Consequently, the cylinder starting fuel supply passage 22 is opened to be constantly in communication with the crankcase 24 irrespective of the location of the piston 27 which reciprocates between the top dead center and the bottom dead center.

The insulator 3 is a synthetic resin member for controlling heat transfer from the engine body 2 to the carburetor 4. The insulator 3 includes an insulator intake passage 31 that communicates with the cylinder intake passage 21 of the engine body 2, an insulator starting fuel supply passage 32 that communicates with the cylinder starting fuel supply passage 22 of the engine body 2 on a lower side of an insulator intake passage 31, and an insulator pulsation transfer passage 33 that is branched from an upper stream (a right side in FIG. 1) of the insulator starting fuel supply passage 32. A pulsation transfer passage 300 as shown in FIG. 1 transfers a pressure variation in the crankcase 24 in accordance with a reciprocation of the piston 27 to a later-described pump 7 (FIG. 2) provided in the carburetor 4. The cylinder pulsation transfer passage 23 of the pulsation transfer passage 300 serves as the cylinder starting fuel supply passage 22, and the insulator pulsation transfer passage 33 serves as a branch portion of the insulator starting fuel supply passage 32.

Figure 2:
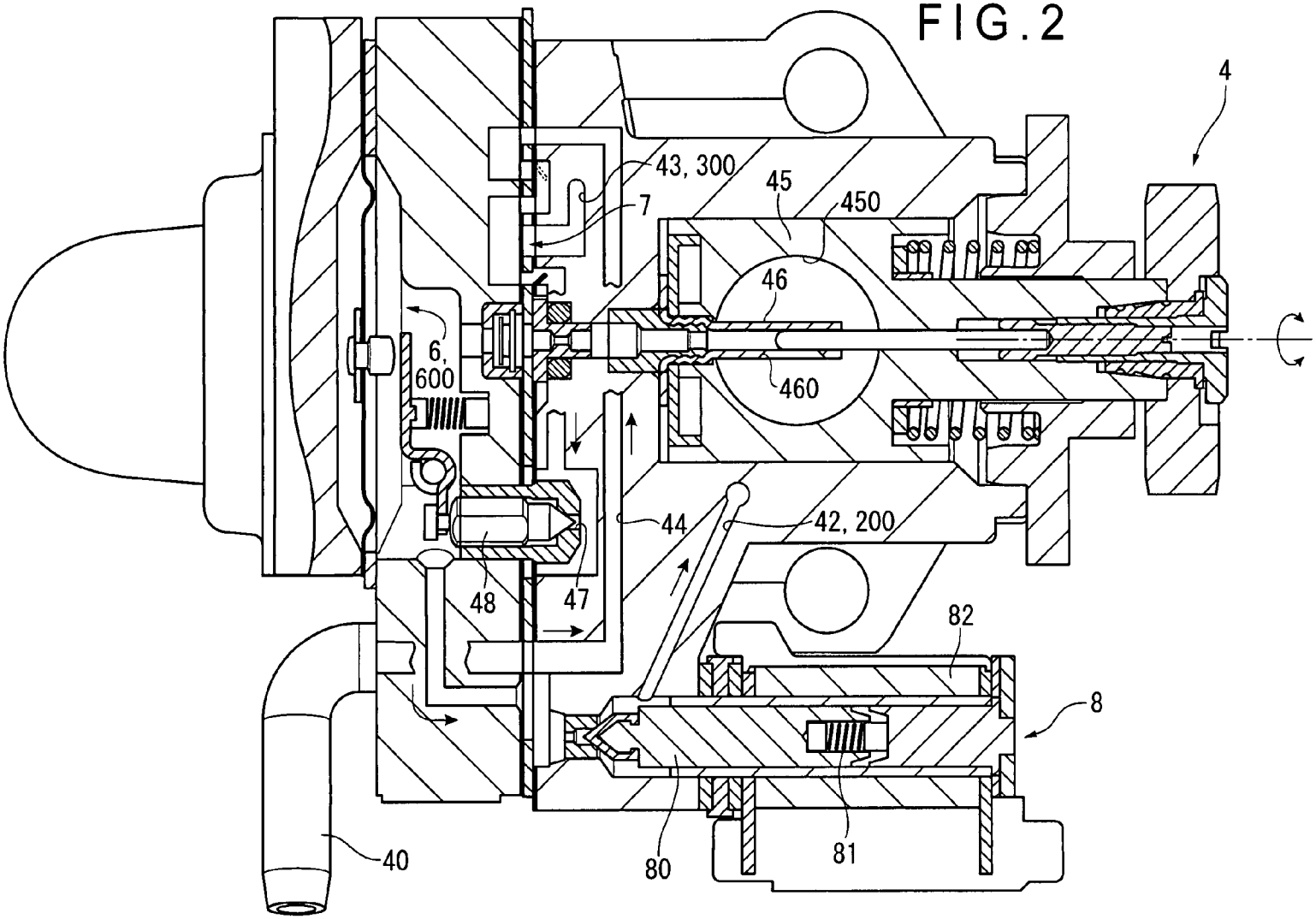
FIG. 2 is a cross sectional view illustrating a main portion of a carburetor in an enlarged manner.

FIG. 2 is a cross sectional view illustrating a main portion of the carburetor 4 in an enlarged manner.

As shown in FIGS. 1 and 2, the carburetor 4 includes a carburetor intake passage 41 which intercommunicates the insulator intake passage 31 and the outside of the engine and which has a venturi-shaped portion on a side close to the outside, a carburetor starting fuel supply passage 42 which intercommunicates the insulator starting fuel supply passage 32 and a fuel reservoir 6 and which is provided below the carburetor intake passage 41, and a carburetor pulsation transfer passage 43 which intercommunicates the insulator pulsation transfer passage 33 and the pump 7.

In this exemplary embodiment, the cylinder intake passage 21, the insulator intake passage 31, and the carburetor intake passage 41 define the intake passage 100. The cylinder starting fuel supply passage 22 (a cylinder pulsation transfer passage 23), the insulator starting fuel supply passage 32 (a branched portion of which is included as the insulator pulsation transfer passage 33), and the carburetor starting fuel supply passage 42 define the starting fuel supply passage 200. The cylinder pulsation transfer passage 23, the insulator pulsation transfer passage 33, and the carburetor pulsation transfer passage 43 define the pulsation transfer passage 300. The diameter of the starting fuel supply passage 200 is smaller than the diameter of the intake passage 100.

As shown in FIG. 2, the carburetor 4 has a typical structure for supplying the fuel to the intake passage 100. Specifically, the carburetor 4 includes: the fuel reservoir 6 for reserving the fuel from a fuel tank (not shown) through an internal flow passage 44 of the carburetor 4 and the inlet pipe 40; the pump 7 for feeding the fuel to the fuel reservoir 6 by the pressure variation in accordance with the reciprocation of the piston 2, the pressure variation transferred from the crankcase 24 through the pulsation transfer passage 300; a rotary valve 45 rotated by a throttle with a through hole 450; a nozzle 46 communicating with the fuel reservoir 6 for feeding the fuel to the through hole 450 from an opening 460 formed at a tip end of the nozzle 46; and a reservoir needle valve 48 for stroking the fuel by opening a communication hole 47 that intercommunicates the internal flow passage 44 and the fuel reservoir 6 after the fuel is fed from the nozzle 46. The fuel reservoir 6 for reserving the fuel to be supplied to the intake passage 100 serves as a starting fuel reservoir 600 for reserving the starting fuel.

Such a carburetor 4 has a solenoid valve 8 as a flow passage opening and closing unit for an automatic choke for opening and closing the starting fuel supply passage 200 (the carburetor starting fuel supply passage 42). The solenoid valve 8 includes a movable core 80, a coil spring 81 that biases the movable core 80 in a left direction in the figure, and a cylindrical coil 82 provided on an outer circumference of the movable core 80.

The starting fuel supply passage 200 is closed by the movable core 80 while the cylindrical coil 82 is not excited. After the cylindrical coil 82 is excited, the movable core 80 is moved against the coil spring 81 in a right direction in the figure so that the starting fuel supply passage 200 is opened.

In addition to the solenoid valve 8, the engine 1 includes a temperature sensor for detecting the temperature of the engine 1, a controller for controlling the solenoid valve 8 in accordance with a detection result of the temperature sensor as components of the automatic choke. The automatic choke is controlled to work when the temperature of the engine 1 is lower than a predetermined temperature.

In the above-described engine 1, the cylindrical coil 82 is excited and the solenoid valve 8 is opened when the automatic choke works at starting. When the piston 27 starts to ascend from the bottom dead center so that a negative pressure is generated in the crankcase 24, the negative pressure is applied in the starting fuel supply passage 200 that intercommunicates the fuel reservoir 6 and the crankcase 24, whereby the starting fuel is fed into the crankcase 24.

Then, the intake port 210 is opened while the piston 27 ascends to the top dead center and the negative pressure in the crankcase 24 is applied in the intake passage 100, whereby the fuel is fed into the intake passage 100 from the nozzle 46 that communicates with the fuel reservoir 6. Subsequently, the fuel and a base air of air-fuel mixture are fed into the crankcase 24 to be mixed with the above-described starting fuel, so that the air-fuel mixture including an excessively enriched fuel is supplied in the crankcase 24.

In the engine 1 according to the exemplary embodiment, the starting fuel supply passage 200 communicates with the crankcase 24 through the groove-shaped portion 220 when the piston 27 is located on a side close to the bottom dead center, and communicates with the crankcase 24 through the lower space of the piston 27 within the cylinder 20 when the piston 27 is located on the other side close to the top dead center. In other words, the starting fuel supply passage 200 is opened to be constantly in communication with the crankcase 24. Thus, simultaneously with the generation of the negative pressure within the crankcase 24 caused when the piston 27 starts to ascend from the bottom dead center, the starting fuel starts to be supplied to the crankcase 24. As compared to the conventional engine in which the starting fuel is supplied to the crankcase 24 only for a short time after the intake port 210 is opened while the piston 27 ascends and until the piston 27 reaches to the top dead center, the starting fuel is supplied to the crankcase 24 for a relatively long time in the engine 1 according to the exemplary embodiment. Even when the negative pressure applied to the crankcase 24 is reduced due to poor sealing properties, a sufficient amount of the fuel can be supplied for starting. Thus, the startability of the engine 1 can be improved.

Until the intake port 210 is opened while the piston 27 ascends, the negative pressure is applied only in the starting fuel supply passage 200 and is not applied in the intake passage 100. Accordingly, the negative pressure applied in the starting fuel supply passage 200 is increased. Thus, the starting fuel can be reliably supplied to the crankcase 24 from the starting fuel supply passage 200.

In addition, the starting fuel can be supplied at a high speed in response to the negative pressure from the crankcase 24 since the starting fuel supply passage 200 has a small diameter.

Since the automatic choke is released after the engine 1 starts, the solenoid valve 8 is closed. The pressure variation in the crankcase 24 due to the reciprocation of the piston 27 is transferred to the pump 7 through the pulsation transfer passage 300 so that the pump 7 starts to work. At this time, the pulsation transfer passage 300 serves as the starting fuel supply passage 200 (the cylinder starting fuel supply passage 22 and the insulator starting fuel supply passage 32 except the branched portion). Thus, it is not necessary to exclusively provide the starting fuel supply passage 200, whereby a structure of the engine can be simplified and a manufacturing cost thereof can be reduced.

Second Exemplary Embodiment

Figure 3:
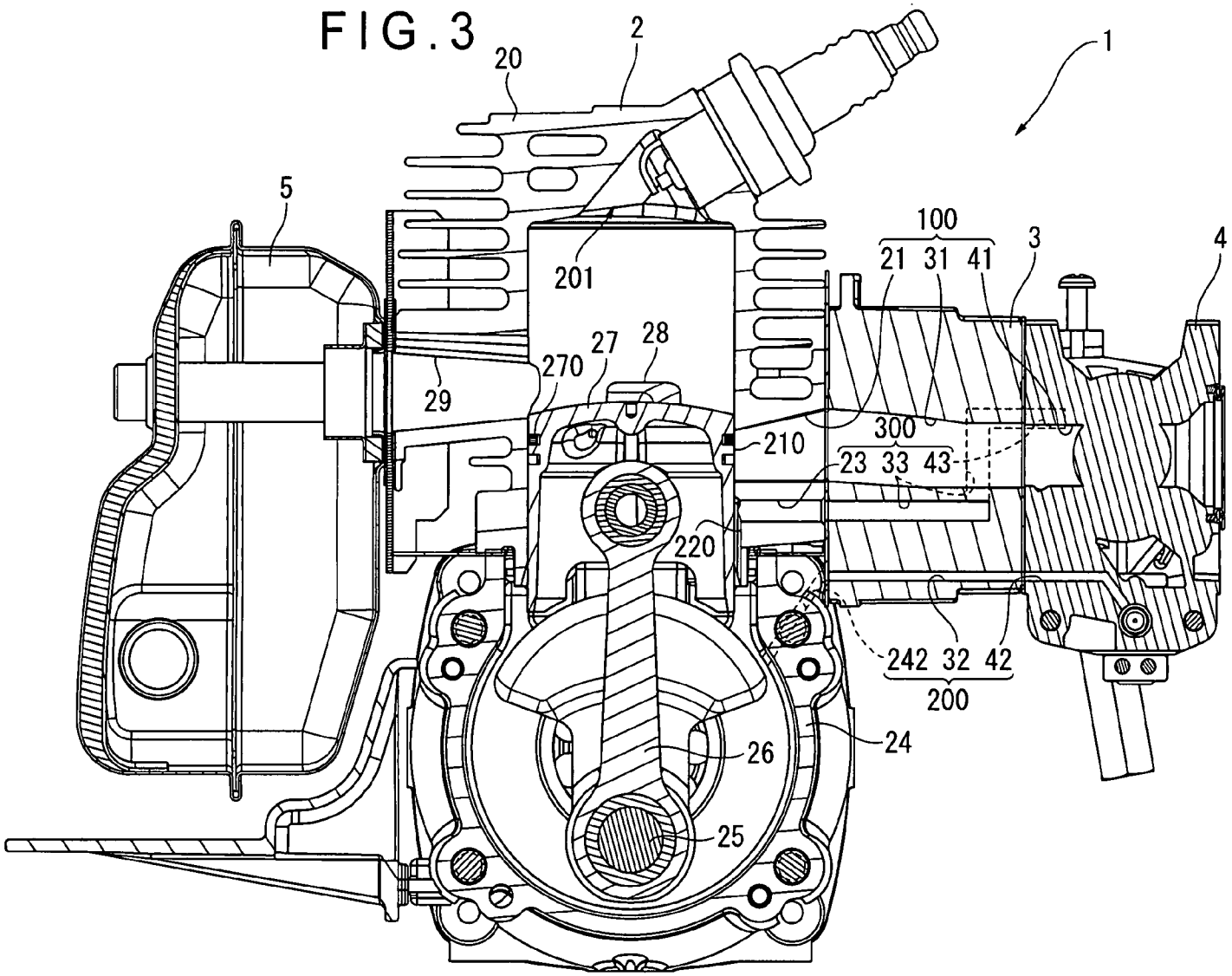
FIG. 3 is a cross sectional view illustrating a two-cycle engine according to a second exemplary embodiment of the invention.

FIG. 3 is a cross sectional view illustrating the two-cycle engine 1 according to a second exemplary embodiment of the invention. In the following description, the same members and functional portions as those of the first embodiment will be denoted by the same reference numerals, and the description thereof will be omitted or simplified.

In the second exemplary embodiment, the starting fuel supply passage 200 is provided separately from the pulsation transfer passage 300 as shown in FIG. 3, unlike the first exemplary embodiment. The engine 1 according to the second exemplary embodiment includes the solenoid valve 8, the temperature sensor, the controller and the like in the same manner as the first exemplary embodiment.

The starting fuel supply passage 200 includes a crankcase starting fuel supply passage 242 which is provided in the crankcase 24 and is apertured directly in the crankcase 24, the insulator starting fuel supply passage 32 which communicates with the crankcase starting fuel supply passage 242 provided separately from the insulator pulsation transfer passage 33, and the carburetor starting fuel supply passage 42 which communicates the insulator starting fuel supply passage 32. The starting fuel supply passage 200 is opened to be constantly in communication with the crankcase 24, thereby intercommunicating the fuel reservoir 6 and the crankcase 24. The diameter of the starting fuel supply passage 200 is smaller than that of the pulsation transfer passage 300. The pulsation transfer passage 300 is the same as that of the first exemplary embodiment, which intercommunicates the crankcase 24 and the pump 7.

In this exemplary embodiment, the starting fuel supply passage 200 is opened to be constantly in communication with the crankcase 24, thereby intercommunicating the fuel reservoir 6 and the crankcase 24. Thus, the same advantages can be obtained as in the first exemplary embodiment. In addition, since the starting fuel supply passage 200 is provided separately from the pulsation transfer passage 300, the degree of freedom in design of the starting fuel supply passage 200 is enhanced in the second exemplary embodiment, as compared to the first exemplary embodiment in which the diameter of a portion serving as the pulsation transfer passage 300 of the starting fuel supply passage 200 is decided in view of a pulsation transfer. Thus, the most appropriate diameter can be provided in view of an excellent response while supplying the starting fuel supply with reliability.

Third Exemplary Embodiment

Figure 4:
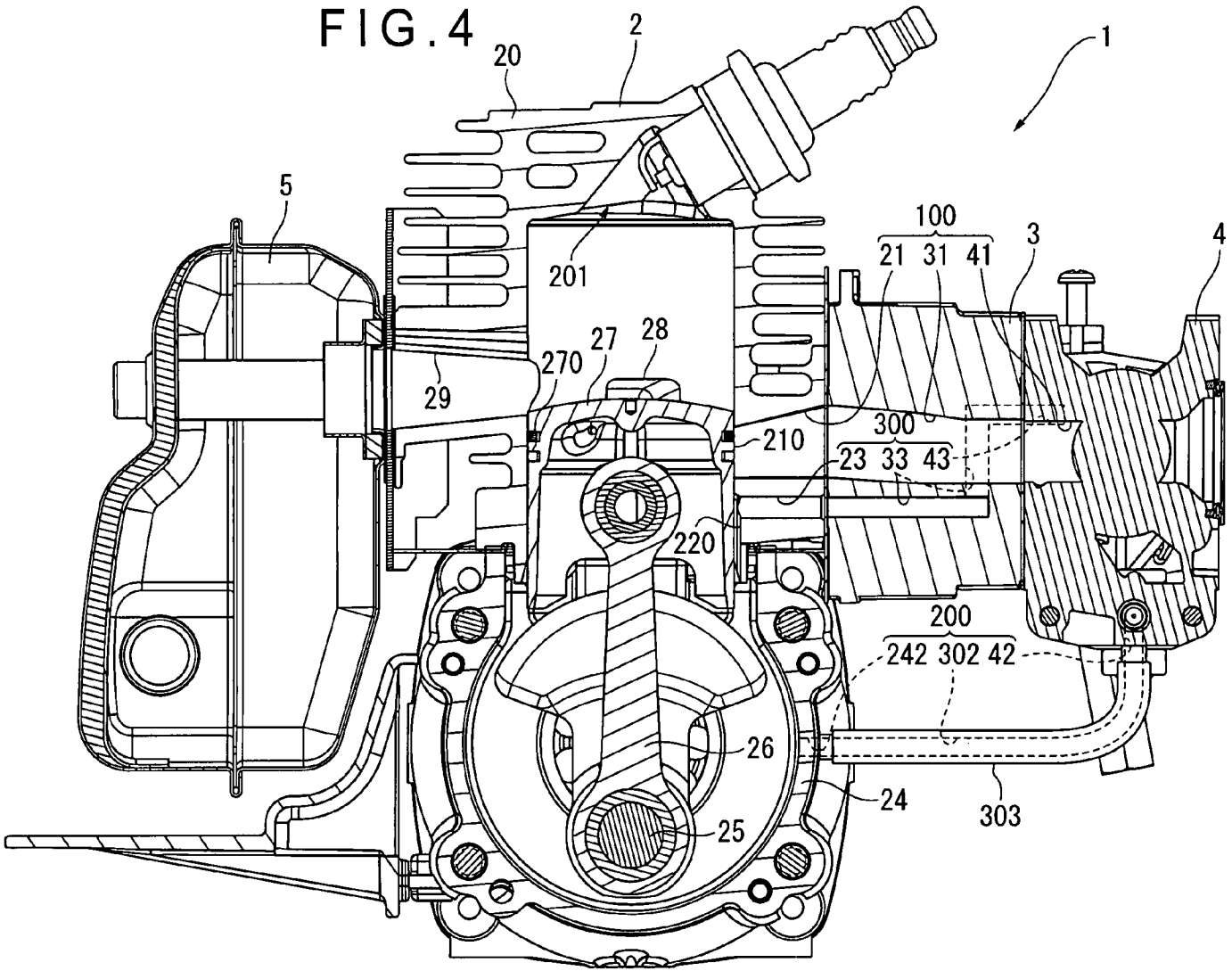
FIG. 4 is a cross sectional view illustrating a two-cycle engine according to a third exemplary embodiment of the invention.

FIG. 4 is a cross sectional view illustrating the two-cycle engine 1 according to a third exemplary embodiment of the invention.

The engine 1 according to the third exemplary embodiment features that the starting fuel supply passage 200 includes a tube 303 that intercommunicates the carburetor 4 and the crankcase 24. The starting fuel supply passage 200 has the most appropriate diameter in the same manner as the second exemplary embodiment.

In this exemplary embodiment, the starting fuel supply passage 200 having the most appropriate diameter is opened to be constantly in communication with the crankcase 24, thereby intercommunicating the fuel reservoir 6 and the crankcase 24. Thus, the same advantages can be obtained as in the first and second exemplary embodiments. In addition, it is not necessary that the carburetor starting fuel supply passage 42 having a complicated shape is provided in the carburetor 4, and is only necessary that the tube 303 is simply attached to the engine 1. Thus, its structure can be simplified and its manufacturing can be facilitated.

The invention is not limited to the exemplary embodiments described above, but includes other arrangements as long as an object of the invention can be achieved, which includes the following modifications.

For example, the starting fuel reservoir 6 provided in the carburetor 4 for reserving the fuel to be supplied to the intake passage 100 may not serve as the starting fuel reservoir 600 for reserving the starting fuel. The starting fuel reservoir 600 may be provided in a dedicated component provided outside the carburetor 4. In other words, it is only necessary that the cylinder starting fuel supply passage 200 is opened to be constantly in communication with the crankcase 24 irrespective of the location of the piston 27 that reciprocates between the top dead point and the bottom dead point, thereby intercommunicating the starting fuel reservoir 600 and the crankcase 24 while the flow passage opening and closing unit is provided in the middle of the staring fuel supply passage 200.

Although the solenoid valve 8 is used as the flow passage opening and closing unit in the exemplary embodiments, an actuator having a piezoelectric motor and the like may be used as the flow passage opening and closing unit. The flow passage opening and closing unit of the invention may have any structures.

The invention claimed is:

1. A two-cycle engine, comprising:

a cylinder;

a crankcase provided adjacent to the cylinder;

an intake passage for feeding an air-fuel mixture into the crankcase;

a starting fuel supply passage for supplying a starting fuel to the crankcase from a starting fuel reservoir; and a flow passage opening and closing unit provided in a midway portion of the starting fuel supply passage, wherein the starting fuel supply passage includes a cylinder starting fuel supply passage which is provided below the intake passage and which is apertured in a groove-shaped portion formed on an inner circumference of the cylinder, and wherein the starting fuel supply passage is opened to be constantly in communication with the crankcase.

2. The two-cycle engine according to claim 1, further comprising:

a carburetor;

a pump for feeding a fuel to be supplied to the intake passage into a fuel reservoir provided in the carburetor from a fuel tank while being operated by a pressure variation in the crankcase; and a pulsation transfer passage for transferring the pressure variation in the crankcase to the pump, wherein the starting fuel reservoir comprises the fuel reservoir provided in the carburetor, and wherein the pulsation transfer passage communicates with the starting fuel supply passage and serves as a part of the starting fuel supply passage.

3. The two-cycle engine according to claim 1, further comprising:

a carburetor;

a pump for feeding a fuel to be supplied to the intake passage into a fuel reservoir provided in the carburetor from a fuel tank while being operated by a pressure variation in the crankcase; and a pulsation transfer passage for transferring the pressure variation in the crankcase to the pump, wherein the starting fuel reservoir comprises the fuel reservoir provided in the carburetor, and wherein the starting fuel supply passage is provided separately from the pulsation transfer passage.

4. The two-cycle engine according to claim 1, wherein a diameter of the starting fuel supply passage is smaller than a diameter of the intake passage.

* * * * *